US007651003B2

(12) United States Patent
Albers et al.

(10) Patent No.: US 7,651,003 B2
(45) Date of Patent: Jan. 26, 2010

(54) VENTING VALVE-TYPE CLOSURE FOR BEVERAGE CONTAINER

(75) Inventors: Martin Albers, Sunden (DE); Frank Römer, Finnentrop (DE)

(73) Assignee: Georg Menshen GmbH & Co. KG, Finnentrop (DE)

( * ) Notice: Subject to any disclaimer, the term of this patent is extended or adjusted under 35 U.S.C. 154(b) by 683 days.

(21) Appl. No.: 11/411,009

(22) Filed: Apr. 25, 2006

(65) Prior Publication Data

US 2006/0249476 A1 Nov. 9, 2006

(30) Foreign Application Priority Data

Apr. 25, 2005 (DE) ..... 10 2005 019 436
Jun. 1, 2005 (DE) ..... 10 2005 025 561

(51) Int. Cl.
*B65D 51/16* (2006.01)
*B67D 3/00* (2006.01)
*A47G 19/22* (2006.01)

(52) U.S. Cl. ..... 215/311; 215/251; 220/714; 222/523; 222/525

(58) Field of Classification Search ..... 215/311, 215/251, 307; 222/153.06, 153.04, 523, 222/524, 525; 220/257.1, 714, 203.04
See application file for complete search history.

(56) References Cited

U.S. PATENT DOCUMENTS 4,673,081 A 6/1987 Habig et al.
4,802,610 A * 2/1989 Cheek et al. ..... 222/481.5
4,807,785 A * 2/1989 Pritchett ..... 222/442
4,967,941 A * 11/1990 Beck ..... 222/521
5,472,120 A * 12/1995 Stebick et al. ..... 222/153.06
5,850,908 A * 12/1998 Jasek ..... 220/203.23
5,881,926 A * 3/1999 Ross ..... 222/192
5,927,565 A * 7/1999 Paczonay ..... 222/484
5,971,225 A * 10/1999 Kapsa ..... 222/212
6,257,453 B1 * 7/2001 Graham ..... 222/153.06
6,334,556 B1 1/2002 Bougamont et al.
7,311,229 B1 * 12/2007 Wrigley ..... 222/518
7,357,278 B2 * 4/2008 Mira Navarro ..... 222/153.04
2002/0074365 A1 6/2002 Young
2003/0168474 A1 * 9/2003 Widgery ..... 222/183
2007/0068975 A1 * 3/2007 Batschied et al. ..... 222/484

FOREIGN PATENT DOCUMENTS

DE 19840858 3/2000
WO WO 9503227 2/1995

* cited by examiner

*Primary Examiner*—Anthony Stashick
*Assistant Examiner*—Niki M Eloshway
(74) *Attorney, Agent, or Firm*—Andrew Wilford

(57) ABSTRACT

A closure used on a beverage container has an outlet neck centered on an axis. The closure has a mount secured to the neck and a valve body formed with an outwardly open passage extending along a passage axis generally coaxial with the outlet-neck axis. This body is pivotally displaceable in the mount about a valve-body axis generally coaxial with the passage axis and outlet-neck axis between an open position and a closed position and through an intermediate position. Structure on the valve body and mount block flow through the passage in the closed position, allow free flow through the passage in the open position, and limit flow through the passage in the intermediate position.

20 Claims, 6 Drawing Sheets

VENTING VALVE-TYPE CLOSURE FOR BEVERAGE CONTAINER

FIELD OF THE INVENTION

The present invention relates to a closure for a beverage container. More particularly this invention concerns such a closure that has an openable and closable valve and that can be used to vent the container.

BACKGROUND OF THE INVENTION

A drink container or bottle typically has a neck centered on an axis and provided with a closure forming a passage running through the closure and having a valve. A valve body of the valve can block the passage in a first closed position and open it in a second open position. The valve body passes between the closed and open positions through an intermediate position in which it lets air into or out of, normally the latter, the container. This way the user can crack the valve to relieve pressure so that he or she is not sprayed by the liquid in the container.

The valve body in such a closure of a drink container normally has a valve body that extends diagonally to the direction of flow of the liquid exiting the container through the closure. In an intermediate position between the closed position and the opened position the container is vented in order to reduce gas pressure inside it, as mentioned above. With this system it is not immediately clear how to operate the valve, that is which way to turn the valve body to open or close it. In addition to this, the closure protrudes considerably out of the container neck.

OBJECTS OF THE INVENTION

It is therefore an object of the present invention to provide an improved closure for a beverage container.

Another object is the provision of such an improved closure for a beverage container that overcomes the above-given disadvantages, in particular that can be easily and ergonomically handled and that can also effect a safe and automatic pressure compensation prior to draining the liquid in the container.

SUMMARY OF THE INVENTION

This object is achieved according to the invention in a closure used on a beverage container having an outlet neck centered on an axis. The closure has a mount secured to the neck and a valve body formed with an outwardly open passage extending along a passage axis generally coaxial with the outlet-neck axis. This body is pivotally displaceable in the mount about a valve-body axis generally coaxial with the passage axis and outlet-neck axis between an open position and a closed position and through an intermediate position. Structure on the valve body and mount block flow through the passage in the closed position, allow free flow through the passage in the open position, and limit flow through the passage in the intermediate position.

Thus according to the invention this object is attained by arranging the rotation axis of the valve body coaxial or parallel to the axis of the passage and/or the container neck having the closure.

A valve body that can be rotated around such a rotation axis is easily mounted by hand in the normal manner as the user is accustomed to unscrewing closures of containers, in particular of bottles, at this axis. Thus the actual closure is especially easy to produce and install.

Preferably the passage runs coaxial through the valve body. An especially space-saving design is achieved if the valve body is at least partially located in the container neck, in particular coaxially.

In a very advantageous variant it is proposed that the valve body have only one controlling port, by which the inner container can be connected to the passage, wherein in the aeration or vent position of the valve body a first area of the valve body port or of a wall port located in the wall where the valve body is supported, which is the single wall port that can be crossed by the valve body port, is opened, the cross section of which is smaller than the remaining second area of the valve body port or of the wall port, which connects the inner container to the passage if the valve is completely opened.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
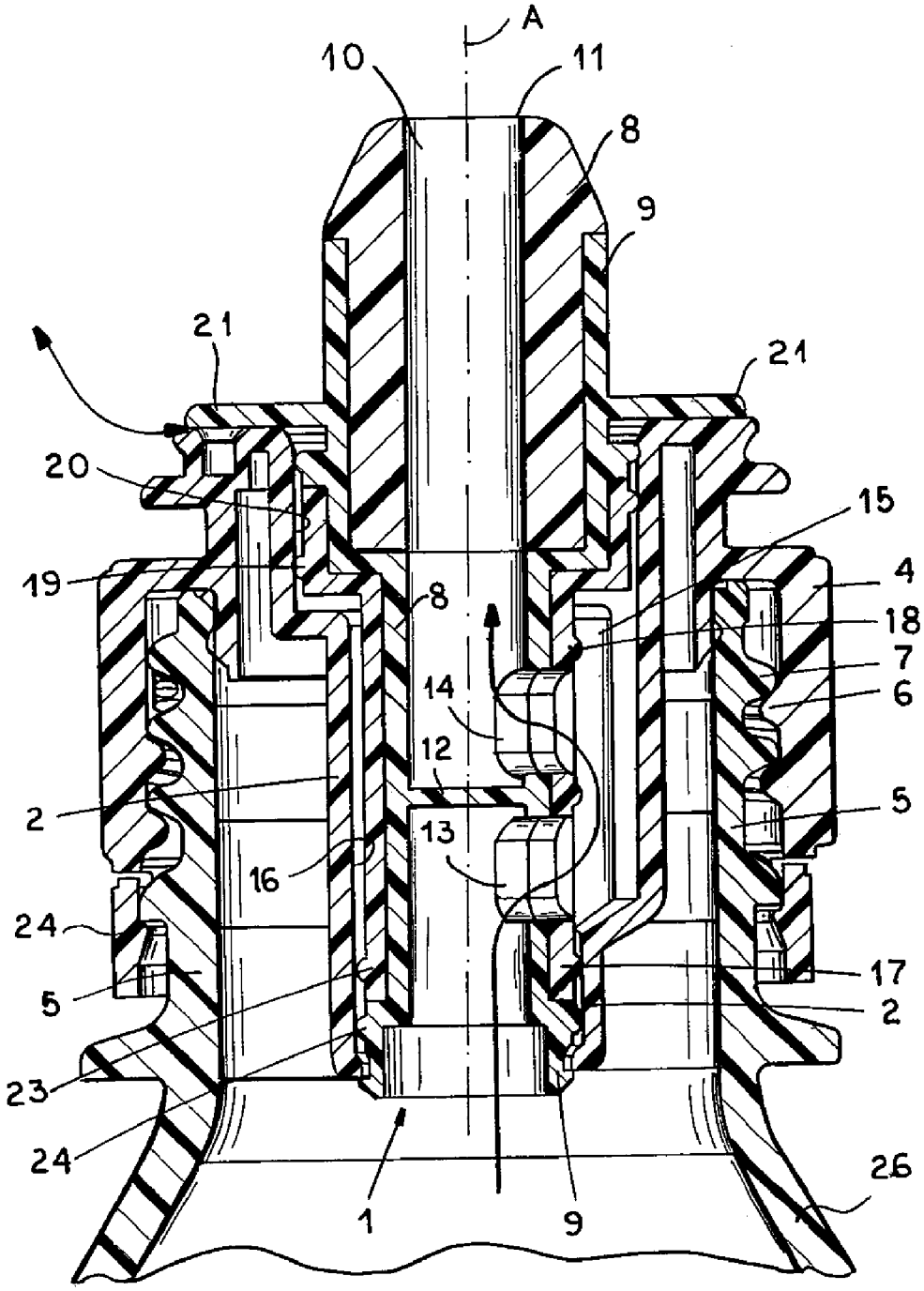
FIG. 1 is an axial section through the closure according to the invention.
Figure 2:
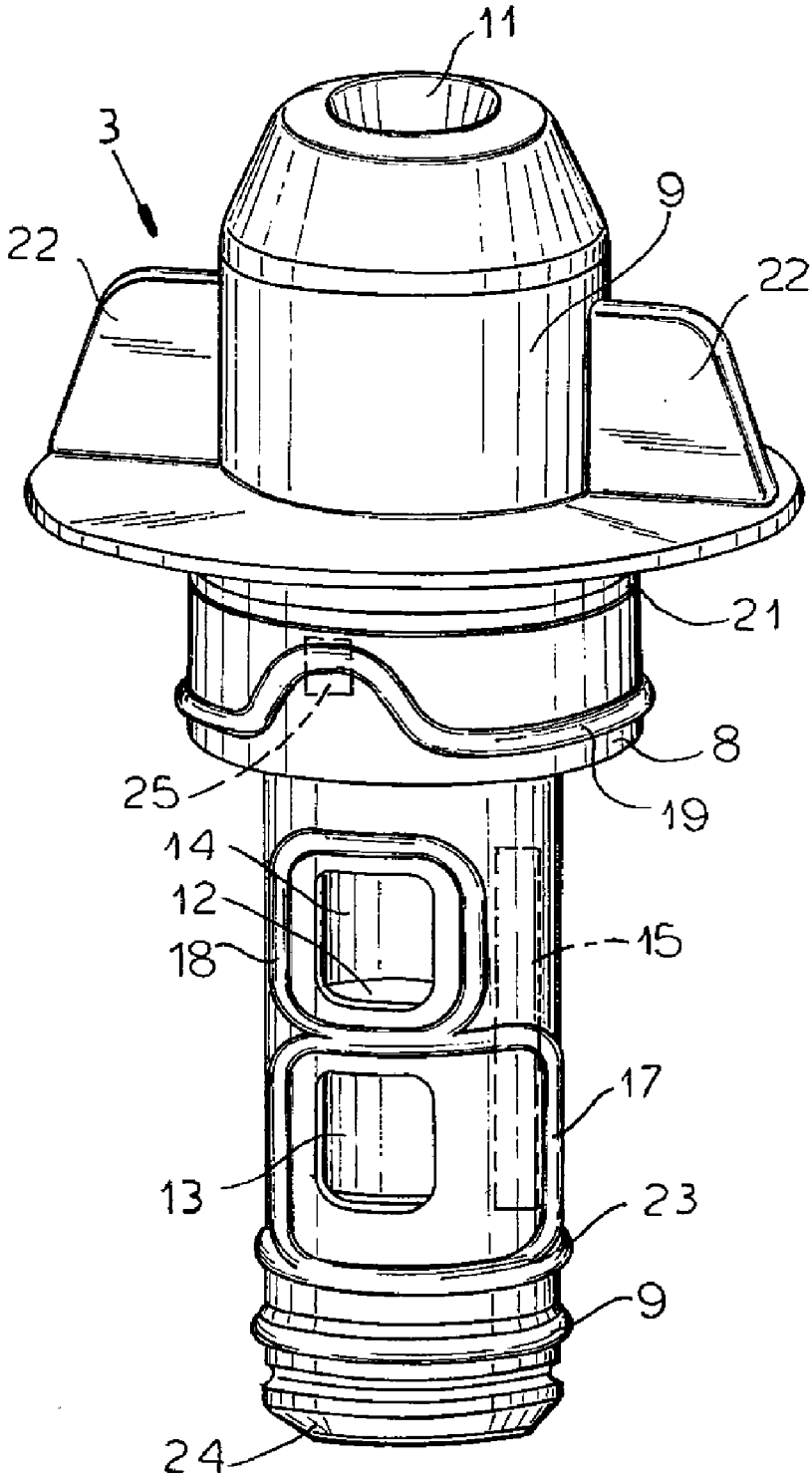
FIG. 2 is a perspective view of the valve body of FIG. 1.
Figure 3:
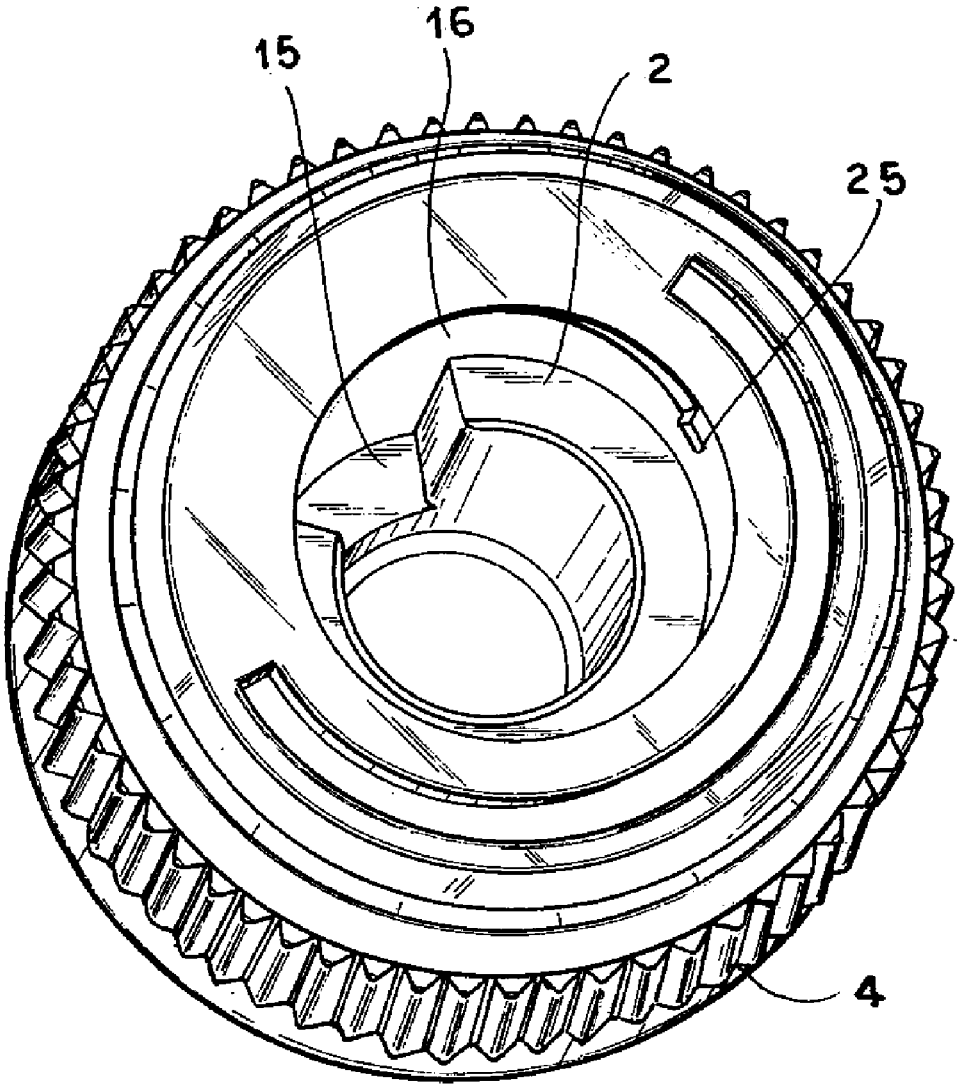
FIG. 3 a perspective view of the closure mount of FIG. 1 without the valve body.

As seen in FIGS. 1-3 a closure 1 according to the invention has a tubularly cylindrical inner part 2 holding a valve body 3 and connected to an outer tubular part 4 formed with an internal screwthread 6 engaging an external screwthread 5 of an outlet or neck 5 of a bottle or container 26. The parts 1-7 are all centered on a common axis A.

The valve body 3 in the inner part 2 therefore protrudes well into the container 26 and projects out of the neck 5 by about half its length. The valve body 3 consists of a soft-plastic part 8 and a hard-plastic part 9. In the lower area the soft-plastic part 8 forms the exterior and in the upper area the hard-plastic part 9 forms the exterior of the body 3.

The valve body 3 is generally tubular and forms along its entire axial length a discharge passage 10 centered on the axis A and opening inside the inner container at a lower end and outside the container at an opening 11 formed as a mouthpiece. Level with the threads 6 and 7 the passage 10 is blocked by a transverse partition wall 12 and subdivided thereby into an upwardly and outwardly open outer portion and a downwardly and inwardly open inner portion. Below and above the partition 12 in the side wall of the valve body 3 are inner and outer radially throughgoing ports 13 and 14. A radially inwardly open and axially extending bypass groove 15 formed in an inner surface 16 of the tube 2 level with the ports 13 can form a fluid-communication path between them in an open position of the valve body 3. Thus, if the valve body 3 is pivoted into the open position of FIG. 1 with the ports 13 and 14 aligned with they bypass groove 15, this groove 15 bridges the ports 13 and 14 so that fluid can leave the bottle 26 through the passage 10, in particular if the bottle 26 is tipped to the side or turned upside down.

As FIG. 2 illustrates, the first port 13 is surrounded by a sealing ridge or bead 17 and the second port 14 by a sealing bead 18 at the exterior wall of the inner part 2. If the valve body 3 is pivoted into a closed position in which the ports 13 and 14 are not connected to the groove 15, these beads 17 and 18 seal the ports 13 and 14 and no fluid can leave the container. If, on the other hand, the valve body 3 is turned from this closed position into the open position illustrated in FIG. 1, fluid can exit as described above.

In an intermediate position between the closed and the opened position, the groove 15 is situated beside the two ports 13 and 14 in the position indicated with a dotted line in FIG. 2, so that the groove 15 has no connection with the second port 14, but with one area of the bead 17 that extends angularly outward from the side of the port 13. Consequently the transition groove 15 is not connected with the port 13 in this intermediate position and high-pressure gases present in the container 26 can move up, passing by the port 14 and rising along the outside of the valve body 3. This way the gases have to pass an annular and radially outwardly projecting seal ridge 19 located above the port 14 on the outer surface of an extension of the valve body 3. An inner wall 20 of the inner part 2 has a recess 25, bridging the ridge 19 and forming a short vent passage, so that the gas can flow up and impinge against the bottom face of a planar flange or plate 21 and reach the outside by flowing radially outward underneath the plate 21. The planar and annular plate 21 is coaxially molded with the hard-plastic part 9 and covers the exterior side of the closure mount 1.

If the valve body 3 is turned from the closed position into the open position, the valve body 3 passes through the intermediate position in which overpressure present in the container is vented (or alternately air is sucked into a vacuum-packed container 26). In order to be able to turn the valve body 3 easily around its axis A by hand, diametrally opposite handle wings 22 are located in the area protruding above the container neck 5 and above the closure mount 1 in the form of coplanar flanges molded with the hard plastic 9 as illustrated in FIG. 2.

For sealing the valve body 3 in the inner part 2 of the closure mount 1, annular beads or ridges 23 are formed not only in the outer surface of the body 1, but at the lower end of the soft plastic 8 as well. Furthermore the lowest or innermost end of the valve body 3 is formed of hard plastic 9 with outwardly projecting annular seal beads 24 that also lock the part 1 in the part 2 axially.

In an unillustrated alternate embodiment the exterior casing 4 of the mount is instead formed by the inner wall of the container neck 5, in particular by means of internal and external threads.

The bottom side of the exterior casing 4 can be connected to a tamper-indicating ring 24 through tiny plastic bars that are torn off if the closure is opened to indicate opening of the closure.

Figure 5:
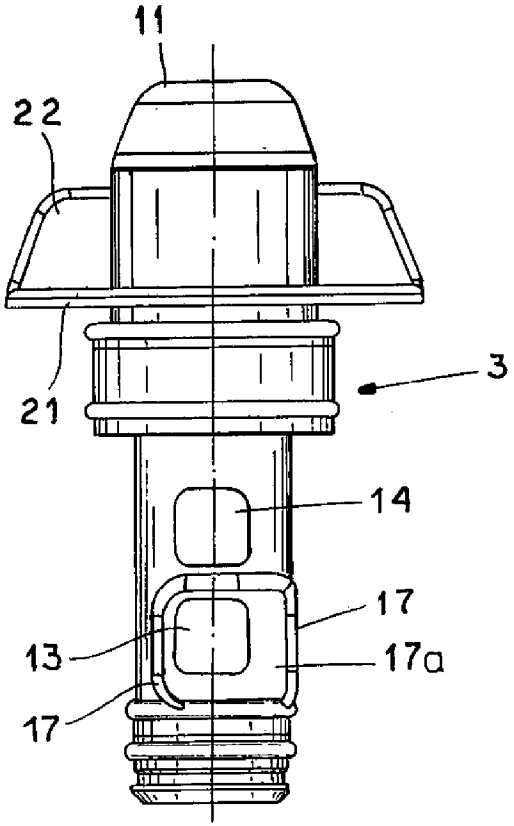
FIG. 5 is a side view of the valve body of the embodiment according to FIG. 4.
Figure 4:
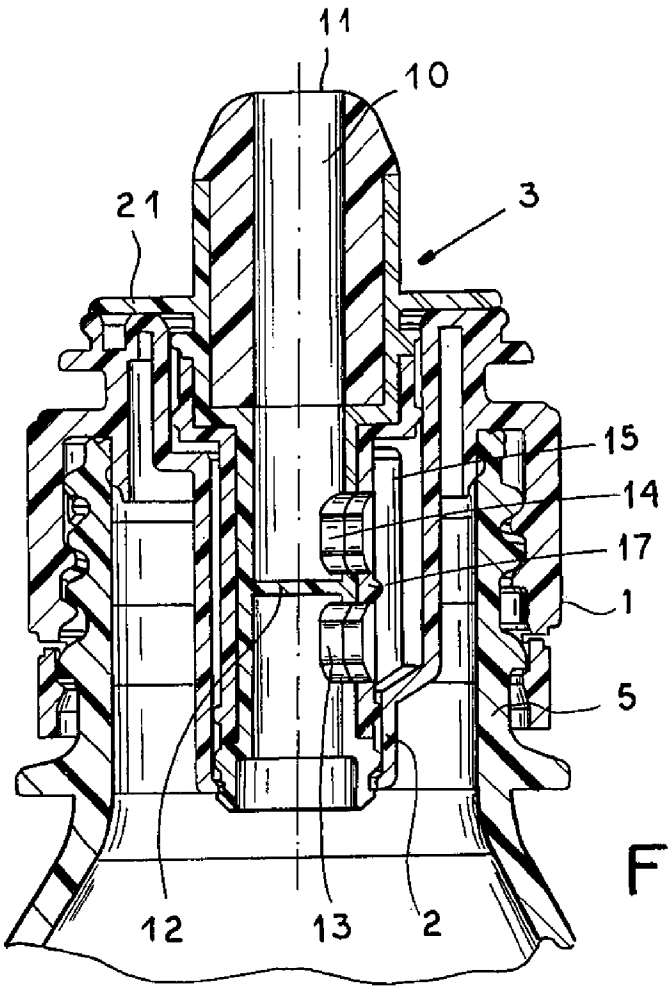
FIG. 4 an axial section through another embodiment of the instant invention.

In the alternate embodiment illustrated in FIGS. 4 and 5 there is no passage running upward beside the valve body 3 for initial pressure venting so that the initial pressure venting is assisted by the bead seal 17 that surrounds the first port 13 and having an extended area 17*a* that is connected to the transition groove 15. This way the first port 13 is at first connected with the transition groove 15 and the second port 14 communicates only through the throttling area 17*a* in order to initially permit only a streaming out of the gas. Only after a further turn of the valve body 3 does the transition groove 15 get into direct contact with the port 13 in order to permit exiting of the liquid. Further throttling elements can be mounted between the area 17*a* and the second port 14, in form of a meander-shaped or narrow path.

Figure 6:
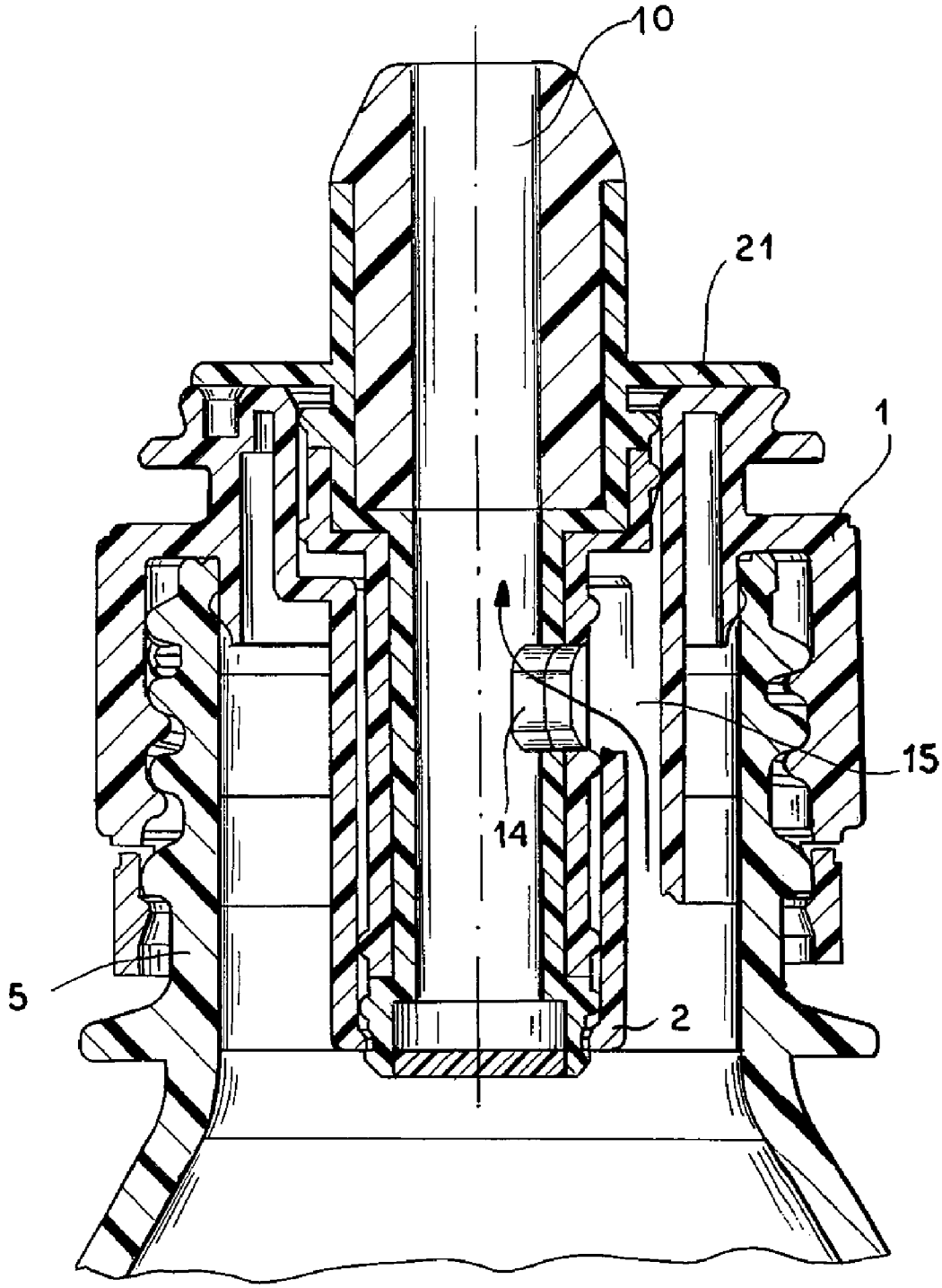
FIG. 6 an axial section through yet another embodiment of the invention.
Figure 7A:
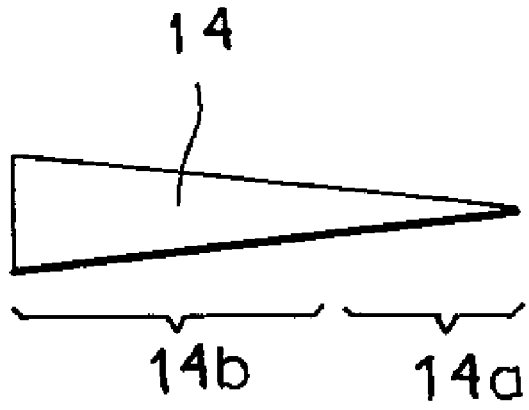
FIGS. 7A, 7B, and 7C are developed views of three different types of ports in the valve body in the embodiment according to FIG. 6.
Figure 7B:
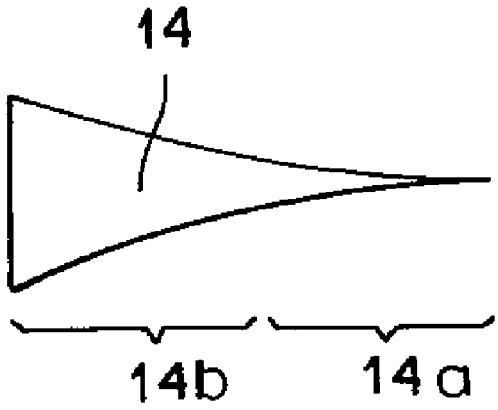
Figure 7C:
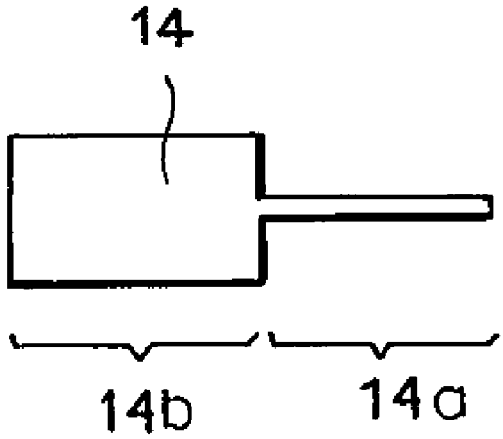

In other alternate embodiments according to FIGS. 6 and 7, the valve body 3 has only one control port 13 in its cylindrical side surface, which in a first area 14*a* forms a significantly smaller passage cross-section than the second area 14*b* of the same port. When the valve is opened, the first area 14*a* is initially opened and through this first area 14*a* the gas under pressure can exit to the discharge passage 10. Only with a further turn of the valve body 3 is the second area 14*b* aligned with the port 13 and then the fluid can flow into the discharge passage 10. This single port 13 narrows in its breadth from the second to the first area and ends at a point in the first area, or respectively in an acute angle. As shown in FIG. 7A it can narrow uniformly to a point having an apex angle smaller than 20°. FIG. 7B shows that it narrows more asymptotically, and in FIG. 7C it narrows in steps.

The controlling port 13 in the valve body 3 can also be of continuous breadth, however, and the opening in the wall, in which the valve body is supported in, and which interacts with the valve body opening, can narrow in width, as described for the valve body opening above. This way the gas pressure relieving effect remains the same.

We claim:

1. In combination with a beverage container having an outlet neck centered on an axis, a closure comprising:
- a mount secured to the neck;
- a valve body formed with
  - an outwardly open passage extending along a passage axis generally coaxial with the outlet-neck axis and having an outwardly open outer portion and an inwardly open inner portion,
  - a transverse partition completely blocking axial flow through the passage between the portions, and
  - radially open inner and outer ports immediately flanking the partition in the respective portions, the mount being formed with an axially extending and radially inwardly open bypass groove level with the partition and with the ports, the body being pivotally displaceable in the mount about a valve-body axis generally coaxial with the passage axis and outlet-neck axis between an open position and a closed position and through an intermediate position, the ports being positioned so as to both open into the bypass passage in the open position and being angularly offset therefrom in the closed position, whereby the partition blocks flow through the passage in the closed position, allows free flow through the passage in the open position, and limits flow through the passage in the intermediate position.

2. The combination defined in claim 1 wherein the passage axis and valve-body axis are coaxial.

3. The combination defined in claim 1 wherein the passage axis and outlet-neck axis are coaxial.

4. The combination defined in claim 1 wherein the valve body is generally tubular.

5. The combination defined in claim 4 wherein the valve body is formed at an outer end as a mouthpiece.

6. The combination defined in claim 1 wherein the mount has a center tube coaxially receiving the valve body and formed with the groove, the valve body being formed with radially outwardly projecting and axially extending ridges flanking the ports and bearing radially outwardly on an inner surface of the center tube.

7. The combination defined in claim 6 wherein the valve body is formed with radially outwardly projecting and angularly extending connecting ridges bridging inner and outer ends of the axial ridges.

8. The combination defined in claim 1 wherein the mount has a center tube coaxially receiving the valve body, the valve body being formed with a radially outwardly projecting annular seal ridge bearing radially outward on an inner surface of the center tube.

9. The combination defined in claim 1 wherein the mount has a center tube coaxially receiving the valve body and formed with the groove, the valve body being formed with an outer transverse end wall outwardly closing the groove.

10. The combination defined in claim 1 wherein the valve body is formed at an outer end with at least one radially extending formation facilitating gripping and rotating the valve body.

11. The combination defined in claim 10 wherein the valve body is formed with two such formations diametrally opposite each other.

12. The combination defined in claim 1 wherein the structure forms a restriction to flow in the intermediate position.

13. The combination defined in claim 12 wherein the restriction is formed by a seal ridge on the valve body.

14. The combination defined in claim 13 wherein the restriction is formed by an extended part of the seal ridge.

15. In combination with a beverage container having an outlet neck centered on an axis, a closure comprising:

a mount secured to the neck;

a valve body formed with an outwardly open passage extending along a passage axis generally coaxial with the outlet-neck axis and a core part forming the passage and made of a soft plastic and an outer part forming the formation and made of a hard plastic, the body being pivotally displaceable in the mount about a valve-body axis generally coaxial with the passage axis and outlet-neck axis between an open position and a closed position and through an intermediate position; and means including structure on the valve body and mount for blocking flow through the passage in the closed position, for allowing free flow through the passage in the open position, and for limiting flow through the passage in the intermediate position.

16. In combination with a beverage container having an outlet neck centered on an axis, a closure comprising:

a mount secured to the neck;

a valve body formed with an outwardly open passage extending along a passage a axis generally coaxial with the outlet-neck axis and a radially open port, the mount being formed with a radially inwardly open groove opening into the container, the body being pivotally displaceable in the mount about a valve-body axis generally coaxial with the passage axis and outlet-neck axis between an open position and a closed position and through an intermediate position; and means including structure on the valve body and mount for blocking flow through the passage in the closed position, for allowing free flow through the passage in the open position, and for limiting flow through the passage in the intermediate position, the port being aligned radially with the groove in the open position.

17. The combination defined in claim 16 wherein the port is angularly elongated and tapers from a broad end to a narrow end, whereby as the broad end is aligned with the groove a flow cross section through the port increases.

18. The combination defined in claim 17 wherein the port has angularly extending converging sides forming an angle of at most 20°.

19. The combination defined in claim 17 wherein the port has angularly extending sides that converge generally asymptotically.

20. In combination with a beverage container having an outlet neck centered on an axis, a closure comprising:

a mount secured to the neck;

a valve body formed with an outwardly open passage extending along a passage axis generally coaxial with the outlet-neck axis and an outer end formed with two diametrally oppositely extending formations facilitating gripping and rotating the valve body, the body being pivotally displaceable in the mount about a valve-body axis generally coaxial with the passage axis and outlet-neck axis between an open position and a closed position and through an intermediate position; and means including structure on the valve body and mount for blocking flow through the passage in the closed position, for allowing free flow through the passage in the open position, and for limiting flow through the passage in the intermediate position.

* * * * *